US007980150B2

(12) United States Patent
Hasegawa et al.

(10) Patent No.: US 7,980,150 B2
(45) Date of Patent: Jul. 19, 2011

(54) ENGINE STARTER HAVING SHIFT LEVER WITH LUBRICANT-BLOCKING WALL

(75) Inventors: Youichi Hasegawa, Kasugai (JP); Tomoya Imanishi, Kariya (JP)

(73) Assignee: Denso Corporation, Kariya (JP)

( * ) Notice: Subject to any disclaimer, the term of this patent is extended or adjusted under 35 U.S.C. 154(b) by 950 days.

(21) Appl. No.: 11/907,368

(22) Filed: Oct. 11, 2007

(65) Prior Publication Data

US 2008/0098850 A1 May 1, 2008

(30) Foreign Application Priority Data

Nov. 1, 2006 (JP) ..... 2006-297960

(51) Int. Cl.
*F02N 15/06* (2006.01)
*F02N 15/02* (2006.01)

(52) U.S. Cl. ..... 74/7 E; 74/6

(58) Field of Classification Search ..... 74/6, 7 R, 74/7 A–7 E, 8, 9
See application file for complete search history.

(56) References Cited

U.S. PATENT DOCUMENTS

| | | | | |
|---|---|---|---|---|
| 4,561,316 | A * | 12/1985 | Bolz et al. | 74/7 E |
| 5,367,913 | A | 11/1994 | Yumiyama et al. | |
| 5,533,415 | A * | 7/1996 | Ackermann et al. | 74/7 E |
| 5,898,229 | A | 4/1999 | Murata et al. | |
| 7,302,869 | B2 * | 12/2007 | Kamei et al. | 74/6 |
| 2005/0081659 | A1 | 4/2005 | Murase et al. | |
| 2007/0137325 | A1 | 6/2007 | Murase et al. | |
| 2009/0133531 | A1 * | 5/2009 | Ono et al. | 74/7 C |

FOREIGN PATENT DOCUMENTS

| | | |
|---|---|---|
| JP | U-60-26288 | 2/1985 |
| JP | U-62-082365 | 5/1987 |
| JP | U-62-184171 | 11/1987 |
| JP | U-1-131873 | 9/1989 |
| JP | A-5-52167 | 3/1993 |
| JP | A-9-209890 | 8/1997 |
| JP | A-10-159835 | 6/1998 |
| JP | A-2002-213329 | 7/2002 |
| JP | A-2005-120899 | 5/2005 |
| JP | A-2007-085317 | 4/2007 |

OTHER PUBLICATIONS

Japanese Office Action issued in Japanese Patent Application No. 2006-297960 on Mar. 2, 2010 (with English translation).

* cited by examiner

*Primary Examiner* — Richard W Ridley
*Assistant Examiner* — Alan B Waits
(74) *Attorney, Agent, or Firm* — Oliff & Berridge, PLC

(57) ABSTRACT

A starter includes a motor, a pinion, a pinion carrier carrying the pinion, a ring member provided on the pinion carrier, a shifting member, and a lubricant blocking member. The ring member is rotatable relative to the pinion carrier and restricted in axial movement toward the pinion. The shifting member has a ring portion that is arranged on the pinion carrier with the ring member interposed between the ring portion and the pinion. The ring portion has an axial end face that has a recess for receiving lubricant and is covered by the ring member. The shifting member is configured to shift, by pushing the ring member with the ring portion, the pinion in the axial direction, thereby bringing the pinion into mesh with a ring gear of an engine. The lubricant blocking member blocks the lubricant from being scattered due to rotation of the pinion carrier with the pinion.

10 Claims, 4 Drawing Sheets

ENGINE STARTER HAVING SHIFT LEVER WITH LUBRICANT-BLOCKING WALL

CROSS-REFERENCE TO RELATED APPLICATION

This application is based on and claims priority from Japanese Patent Application No. 2006-297960, filed on Nov. 1, 2006, the content of which is hereby incorporated by reference in its entirety into this application.

BACKGROUND OF THE INVENTION

1. Technical Field of the Invention

The present invention relates to starters having a pinion and a shift lever that shifts the pinion into mesh with a ring gear of an engine.

2. Description of the Related Art

Japanese Patent First Publication No. 2007-85317 discloses an engine starter that includes a low-cost shift lever, which is made of resin, and has an improved structure for effectively suppressing wear and thermal deformation of the shift lever.

More specifically, as shown in FIG. 4, the starter includes an output shaft 100, a pinion 140 provided on the output shaft 100, the resin-made shift lever that has a lever ring 110 provided on the output shaft 100, a pair of ring washers 120 and 130 that are provided on the output shaft 100 respectively on the front and rear sides of the lever ring 110, and a lever washer 150 interposed on the output shaft 100 between the front-side ring washer 120 and the lever ring 110. The lever ring 110 has formed, on its axial end face abutting the lever washer 150, a groove 111 that is filled with lubricant (e.g., grease).

Since there is no one-way clutch provided between the pinion 140 and the output shaft 100, in an overrun state where torque generated by the engine is transmitted from the ring gear to the pinion 140, the output shaft 100 will be rotated at a very high speed which is equal to the product of the engine speed and the gear ratio between the ring gear and the pinion 140. However, since the lever washer 150 lags the front-side ring washer 120 in rotational speed, that is, it rotates slower than the ring washer 120 because it is not fixedly coupled to the ring washer 120, the difference in rotational speed between the lever washer 150 and the lever ring 110 will be small. Further, by virtue of the lubricating function of the grease, the friction between the lever washer 150 and the lever ring 110 can be considerably decreased. As a result, both wear and thermal deformation of the lever ring 110 (i.e., the shift lever) due to friction can be effectively suppressed.

However, at the same time, since the axial end face of the lever ring 110, where the groove 111 is formed, is made flat, a large amount of grease will be scattered due to rotation of the lever washer 150. More specifically, in the overrun state, the lever washer 150 is dragged by the front-side ring washer 120 to rotate, thus causing the grease having flowed out of the groove 111 and adhered to the surface of the lever washer 150 to be scattered radially outward due to centrifugal force. Consequently, the grease filled in the groove 111 can be prematurely exhausted, thus making it difficult to suppress wear and thermal deformation of the lever ring 110 over a long time period.

SUMMARY OF THE INVENTION

The present invention has been made in view of the above-mentioned problem.

According to one aspect of the present invention, there is provided a starter for starting an engine which includes a motor, a pinion, a pinion carrier, a ring member, a shifting member, and a lubricant blocking member. The pinion carrier carries the pinion and is driven by the motor to rotate together with the pinion. The ring member is provided on the pinion carrier; the ring member is rotatable relative to the pinion carrier and restricted in movement in an axial direction of the motor toward the pinion. The shifting member has a ring portion that is arranged on the pinion carrier with the ring member interposed between the ring portion and the pinion in the axial direction. The ring portion has an axial end face that has a recess for receiving lubricant and is covered by the ring member. The shifting member is configured to shift, by pushing the ring member with the ring portion, the pinion in the axial direction, thereby bringing the pinion into mesh with a ring gear of an engine to start the engine. The lubricant blocking member is positioned to block the lubricant from being scattered during rotation of the pinion carrier with the pinion.

Since the ring member is rotatable relative to the pinion carrier, in an overrun state where torque generated by the engine is transmitted from the ring gear to the pinion, the ring member will lag the pinion and the pinion carrier in rotational speed due to the viscosity of the lubricant which has flowed out of the recess of the ring portion of the shifting member and adhered to the surface of the ring member. Consequently, the difference in rotational speed between the ring member and the ring portion of the shifting member will accordingly be small. Further, by virtue of the lubricating function of the lubricant, the friction between the ring member and the ring portion of the shifting member can be considerably decreased. As a result, both wear and thermal deformation of the ring portion of the shifting member due to friction can be effectively suppressed. Moreover, with the lubricant blocking member, the lubricant filled in the recess of the ring portion of the shifting member can be prevented from being prematurely exhausted, thus making it possible to suppress wear and thermal deformation of the ring portion over a long time period.

BRIEF DESCRIPTION OF THE DRAWINGS

The present invention will be understood more fully from the detailed description given hereinafter and from the accompanying drawings of one preferred embodiment of the invention, which, however, should not be taken to limit the invention to the specific embodiment but are for the purpose of explanation and understanding only.

In the accompanying drawings.

DESCRIPTION OF PREFERRED EMBODIMENT

One preferred embodiment of the present invention will be described hereinafter with reference to FIGS. 1-3.

Figure 1:
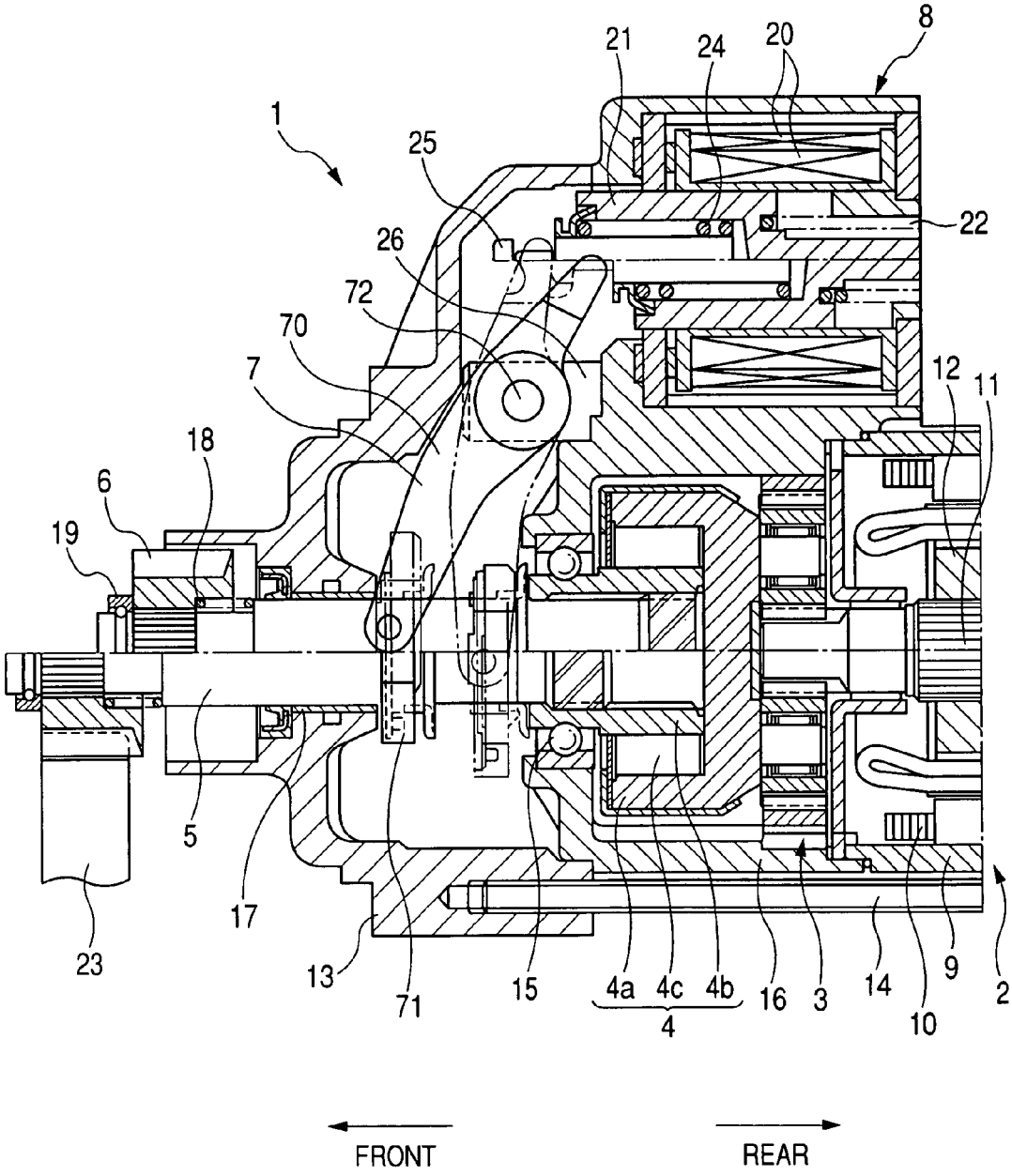
FIG. 1 is a partially cross-sectional side view showing the overall structure of a starter according to an embodiment of the invention.

FIG. 1 shows the overall structure of a starter 1 according to an embodiment of the invention, which is designed to start an internal combustion engine (not shown) of a motor vehicle.

As shown in FIG. 1, the starter 1 includes a motor 2 that generates torque, a speed reduction gear 3 for reducing the rotational speed of the motor 2, a clutch 4, an output shaft 5 that is linked to the speed reduction gear 3 via the clutch 4, a pinion 6 carried on the output shaft 5, a shift lever 7, and a solenoid or electromagnetic switch 8 that operates supply of electric power to the motor 2 and causes the shift lever 7 to shift the output shaft 5 in the axial direction.

It should be noted that in FIG. 1, the upper parts of some components with respect to the axis of the output shaft 5 or the axis of the solenoid switch 8 show those components in a first starter state, and the lower parts show the same in a second starter state. In the first starter state, the pinion 6 is not in mesh with a ring gear 23 of the engine; in the second starter state, the pinion 6 is in mesh with the ring gear 23. In addition, in FIG. 1, the shift lever 7 in the first starter state is shown with a solid line, and the shift lever 7 in the second starter state is shown with a chained line.

The motor 2 is of a well-known DC type. The motor 2 includes a cylindrical yoke 9, a plurality of field windings 10 arranged on the inner periphery of the yoke 9 to create a magnetic field, an armature 12 having an armature shaft 11 and a commutator (not shown) provided on a rear end portion of the armature shaft 11, and brushes (not shown) that slide on the commutator during rotation of the armature shaft 11 to supply electric power to the armature 12. It should be noted that a plurality of permanent magnets can be used, instead of the field windings 10, to create the magnetic field. In addition, the motor 2 is fixed to a housing 13 of the starter 1 by means of a plurality of through bolts 14.

The speed reduction gear 3 is of a well-known epicyclic type. The speed reduction gear 3 is arranged on a front end portion of the armature shaft 11, so that it is concentric with the armature shaft 11.

The clutch 4 includes an outer ring 4*a*, an inner ring 4*b*, and a plurality of rollers 4*c* interposed between the outer ring 4*a* and the inner ring 4*b*. The outer ring 4*a* is driven by the motor 2 via the speed reduction gear 3. The inner ring 4*b* is rotatably supported by a center case 16 of the starter 1 via a bearing 15. The clutch 4 is a one-way clutch which allows torque transmission from the outer ring 4*a* to the inner ring 4*b* via the rollers 4*c* while inhibiting torque transmission from the inner ring 4*b* to the outer ring 4*a*.

The center case 16 is sandwiched between the yoke 9 of the motor 2 and the housing 13, so as to enclose both the speed reduction gear 3 and the clutch 4.

The output shaft 5 is coaxially disposed with the armature shaft 11. The output shaft 5 has a front end portion that is rotatably and axially-slidably supported by the housing 13 via a bearing 17 and a rear end portion that is located within the inner ring 4*b* of the clutch 4 to engage with the inner ring 4*b* through helical splines.

The pinion 6 is provided on a protruding portion of the output shaft 5, which protrudes forward from the bearing 17, to engage with the protrudirig portion through straight splines. The pinion 6 is urged forward by a pinion spring 18 that is provided between the output shaft 5 and the pinion 6. At the same time, forward movement of the pinion 6 is restricted by a stop ring 19 that is mounted on the front end of the protruding portion of the output shaft 5.

The solenoid switch 8 includes a solenoid 20 and a plunger 21. The solenoid 20 is configured to be energized upon turning on a start switch (not shown). The plunger 21 is configured to move axially (i.e., forward and backward) within the solenoid 20.

When energized, the solenoid 20 creates a magnetic attraction which attracts the plunger 21 to move backward against the force of a return spring 22, thereby causing main contacts (not shown) of a motor circuit for supplying electric power to the motor 2 to be closed. When the solenoid 20 is deenergized, the magnetic attraction for the. plunger 21 disappears; thus, the plunger 21 is moved forward by the force of the return spring 22 to return to its initial position, thereby opening the main contacts of the motor circuit.

To the plunger 21, there are mounted a drive spring 24 for developing a shifting force for shifting the pinion 6 into mesh with the ring gear 23 and a hook 25 for transmitting motion of the plunger 21 to the shift lever 7 via the drive spring 24.

Figure 2B:
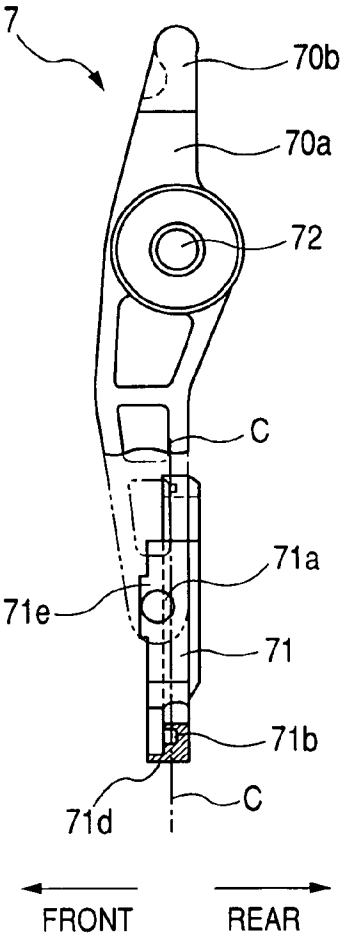
FIGS. 2A and 2B are respectively front and side views of a shift lever of the starter.
Figure 2A:
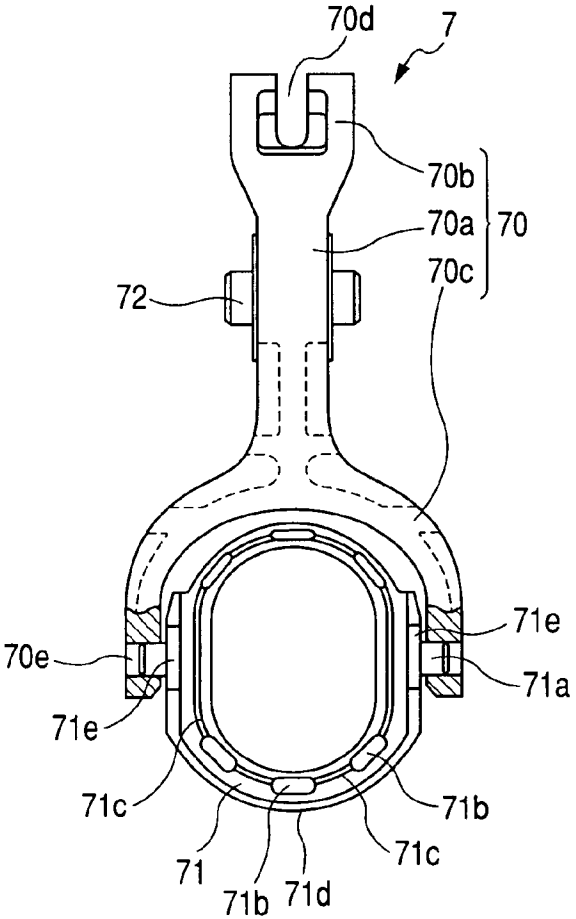

Referring now to FIGS. 2A and 2B, the shift lever 7 includes a lever arm 70 and a lever ring 71, both of which are made of resin.

The lever arm 70 includes a body portion 70*a* that has a lever pin 72 fixed thereto, a head portion 70*b* for engaging with the hook 25, and a leg portion 70*c* for holding the lever ring 71. The lever arm 70 is pivotally held, as shown in FIG. 1, by a lever holder 26 via the lever pin 72.

More specifically, in the present embodiment, the lever holder 26 is fixed to the center case 16. The lever pin 72 is press-fit in a through-hole formed in the body portion 70*a* of the lever arm 70 with end portions thereof protruding from the through-hole. The lever holder 26 holds the end portions of the lever pin 21 so that the lever arm 70 can pivot on the lever pin 21.

The head portion 70*b* has formed therein a groove 70*d* for engaging with the hook 25. The leg portion 70*c* is bifurcated, as shown in FIG. 2A, to have two end portions in which a pair of engaging holes 70*e* are respectively formed.

The lever ring 71 is shaped, for example, in an elliptical or "O" ring as shown in FIG. 2A. The lever ring 71 has a pair of engaging pins 71*a* formed integrally therewith. More specifically, the engaging pins 71*a* are respectively formed on a pair of base portions 71*e* of the lever ring 71 that are opposite to each other in a radial direction of the lever ring 71. The engaging pins 71*a* are respectively inserted in the engaging holes 70*e* of the leg portion 70*c* of the lever arm 70, thereby being rotatably supported by the lever arm 70. Moreover, in the present embodiment, the engaging pins 71*a* are formed so as to be forward offset from the axial center C-C of the lever ring 71, as shown in FIG. 2B.

Figure 3:
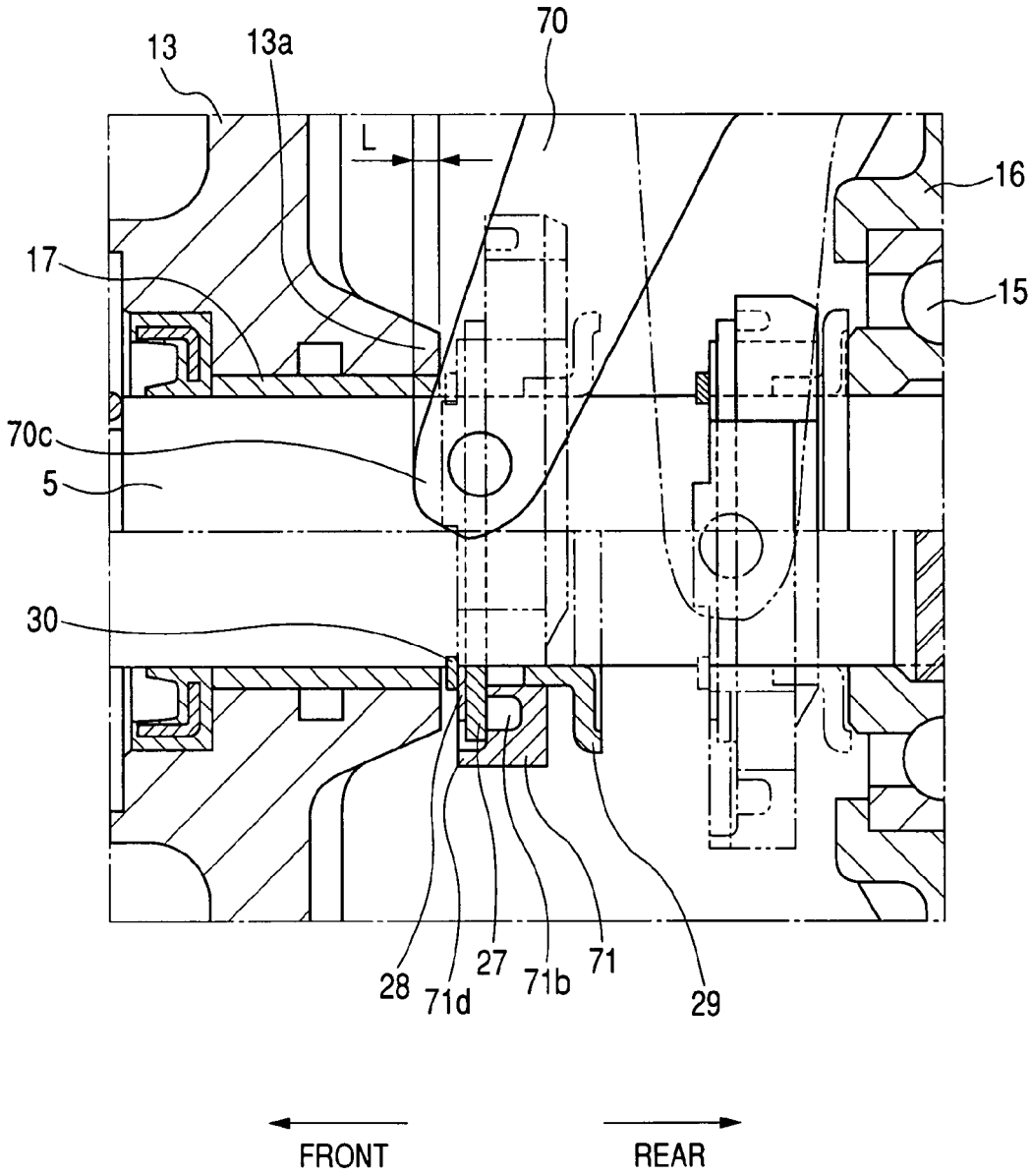
FIG. 3 is an enlarged partially cross-sectional side view showing part of the starter.
Figure 4:
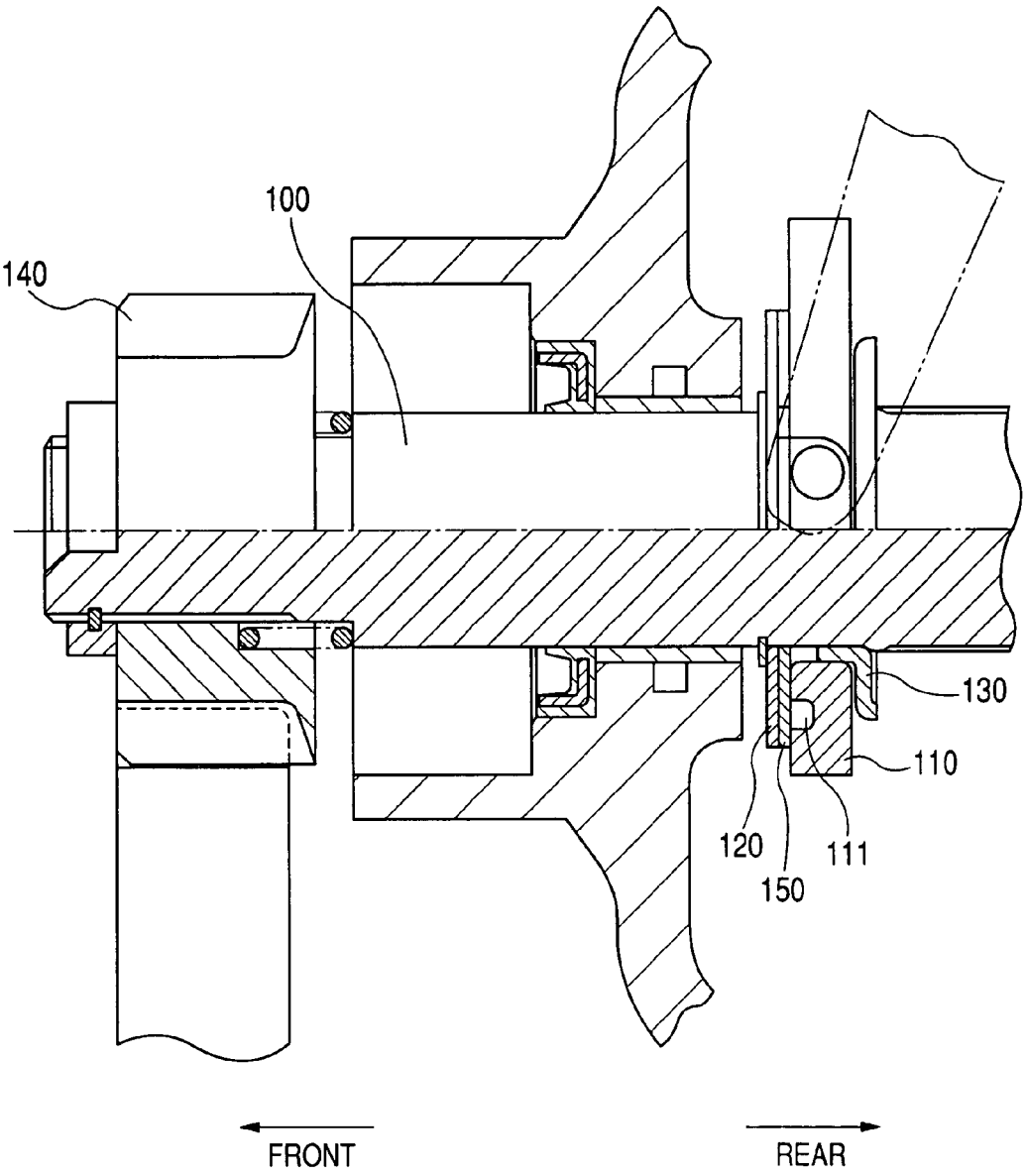
FIG. 4 is a partially cross-sectional side view showing part of a related starter.

Referring further to FIG. 3, the lever ring 71 is provided on the output shaft 5 and is axially movable with respect to the output shaft 5.

On the output shaft 5, there are also provided a pair of ring washers 28 and 29 respectively on the front and rear sides of the lever ring 71. The ring washers 28 and 29 are also axially movable with respect to the output shaft 5. However, forward movement of the front-side ring washer 28 is restricted by a snap ring 30 fixed to the output shaft 5, while backward movement of the rear-side ring washer 29 is restricted by a step portion (not shown) of the output shaft 5.

Further, on the output shaft 5, there is interposed a lever washer 27 between the front-side ring washer 28 and the lever ring 71. The lever washer 27 is axially movable with respect to the output shaft 5 and rotatable with respect to both the front-side ring washer 28 and the lever ring 71. In addition, the lever washer 27 has a larger outer diameter than the front-side ring washer 28.

The lever ring 71 has a front end face that has a plurality of recesses 71*b* formed thereon and is covered by the lever washer 27. As shown in FIG. 2A, the recesses 71*b* are spaced in the circumferential direction of the lever ring 71 and communicate with each other via communication grooves 71*c*. All the recesses 71*b* and communication grooves 71*c* are filled with grease.

The lever ring 71 further has a side wall 71*d* that protrudes forward from a radially outer periphery of the front end face of the lever ring 71.

In the present embodiment, the side wall 71*d* functions as a grease blocking member to block the grease filled in the recesses 71*b* and communication grooves 71*c* from being scattered due to rotation of the lever washer 27. The side wall 71*d* has a protruding height in the axial direction which is greater than the axial thickness of the lever washer 27, as shown in FIG. 3. Moreover, the side wall 71*d* extends in the circumferential direction of the lever ring 71 so that when the starter 1 is installed to the engine, the side wall 71*d* occupies at least the vertically lower half of the outer circumference of the lever ring 71, as shown in FIG. 2A. Further, the side wall 71*d* connects together the base portions 71*e* of the lever ring 71 on which the engaging pins 71*a* are respectively formed.

After having described the overall structure of the starter 1, the operation thereof will now be described.

When the start switch is turned on, the solenoid 20 of the solenoid switch 8 is energized to create the magnetic attraction, which attracts the plunger 21 to move backward against the force of the return spring 22. The backward movement of the plunger 21 causes the shift lever 71 to pivot clockwise, pushing the lever washer 27 forward with the lever ring 71 thereof. The pushing force is then transmitted from the lever washer 27, via the front-side ring washer 28 and the snap ring 30, to the output shaft 5, causing the output shaft 5 to be shifted forward along the inner ring 4*b* of the clutch 4. When the front end face of the pinion 6 makes contact with the rear end face of the ring gear 23, the output shaft 5 stops against the force of the pinion spring 18.

Then, the plunger 21 further moves backward against both the forces of the return spring 22 and the drive spring 24, thereby causing the main contacts of the motor circuit to be closed. As a result, electric power is supplied from a battery of the vehicle to the motor 2, enabling the motor 2 to generate torque. The generated torque is then transmitted, via the speed reduction gear 3 and the clutch 4, to the output shaft 5, causing the output shaft 5 to rotate together with the pinion 6. When the pinion 6 rotates to a position in which it can be meshed with the ring gear 23, the output shaft 5 is further shifted forward by the shifting force developed in the drive spring 24, thereby bringing the pinion 6 into mesh with the ring gear 23. Consequently, the torque generated by the motor 2 is transmitted from the pinion 6 to the ring gear 23, thereby starting the engine.

After the engine has started, the start switch is turned off, causing the solenoid 20 to be deenergized. Consequently, the magnetic attraction for the plunger 21 disappears, so that the plunger 21 is moved backward by the force of the return spring 22 to its initial position, causing the main contacts of the motor circuit to be opened. As a result, the electric power supply from the battery to the motor 2 is interrupted, thus causing the starter 1 to stop. At the same time, the backward movement of the plunger 21 causes the shift lever 7 to pivot counterclockwise, pushing the rear-side ring washer 29 backward with the lever ring 71 thereof. The pushing force is then transmitted from the ring washer 29 to the output shaft 5, causing the output shaft 5 to be shifted backward along the inner ring 4*b* of the clutch 4 to its initial position. As a result, the pinion 6 is brought out of mesh with the ring gear 23.

The above-described starter 1 according to the present embodiment has the following advantages.

In an overrun state where the pinion 6 remains in mesh with the ring gear 23 and torque generated by the engine is transmitted from the ring gear 23 to the pinion 6, the output shaft 5 will be rotated at a very high speed (i.e., a speed equal to the product of the engine speed and the gear ratio between the ring gear 23 and the pinion 6) because there is no one-way clutch provided between the pinion 6 and the output shaft 5. The front-side ring washer 28 will also be rotated along with the output shaft 5, dragging the lever washer 27 to rotate therewith. However, due to the viscosity of the grease which has flowed out of the recesses 71*b* of the lever ring 71 and adhered to the surface of the lever washer 27, the lever washer 27 will lag the front-side ring washer 27 in rotational speed. Consequently, the difference in rotational speed between the lever washer 27 and the lever ring 71 will accordingly be small. Further, by virtue of the lubricating function of the grease, the friction between the lever washer 27 and the lever ring 71 can be considerably decreased. As a result, both wear and thermal deformation of the lever ring 71 due to friction can be effectively suppressed.

Moreover, since there is provided in the starter 1 the grease blocking member, i.e., the side wall 71*d* of the lever ring 71, the grease can be blocked from being scattered radially outward due to rotation of the lever washer 27. Consequently, the grease filled in the recesses 71*b* of the lever ring 71 can be prevented from being prematurely exhausted, thus making it possible to suppress wear and thermal deformation of the lever ring 71 over a long time period.

In the present embodiment, the side wall 71*d* of the lever ring 71 has the protruding height in the axial direction which is greater than the axial thickness of the lever washer 27.

With the above configuration, it is possible to more reliably block the grease from being scattered over the side wall 71*d*. Moreover, the grease blocked by the side wall 71*d* can flow into the air gap between the lever washer 27 and the front-side ring washer 28, thereby decreasing wear of the washers 27 and 28.

In the present embodiment, the side wall 71*d* extends in the circumferential direction of the lever ring 71 so that when the starter 1 is installed to the engine, the side wall 71*d* occupies at least the vertically lower half of the outer circumference of the lever ring 71.

With the above configuration, when the vehicle vibrates, the side wall 71*d* can effectively block the grease from dropping downward due to the vibration.

In the present embodiment, the engaging pins 71*a*, which serve as connecting portions of the lever ring 71 to connect the lever ring 71 to the lever arm 70, are forward offset from the axial center C-C of the lever ring 71.

With the above configuration, the leg portion 70*c* of the lever arm 70 can overlap a bearing portion 13*a* of the housing 13, in which the bearing 17 supporting the output shaft 5 is provided, by a distance L in the axial direction, as shown in FIG. 3, thereby reducing the overall axial length of the starter 1.

Further, in the present embodiment, the side wall 71*d* extends in the circumferential direction of the lever ring 71 to connect together the base portions 71*e* of the lever ring 71 on which the engaging pins 71*a* are respectively formed.

With this configuration, the side wall 71*d* can serve as a reinforcing rib to reinforce the base portions 71*e*. Consequently, though the engaging pins 71*a* are forward offset from the axial center C-C of the lever ring 71, it is still possible to reliably prevent the base portions 71*e* from crumbling due to the frictional heat generated between the lever ring 71 and the lever washer 27.

In the present embodiment, the front-side ring washer 28 is rotatable with respect to the lever washer 27 and has a smaller outer diameter than the lever washer 27.

With this configuration, during rotation of the front-side ring washer 28 along with the output shaft 5, it is difficult for the ring washer 28 to drag the lever washer 27 to rotate therewith. Consequently, the difference in rotational speed between the lever washer 27 and the lever ring 71 can be accordingly decreased, thus further effectively suppressing both wear and thermal deformation of the lever ring 71.

While the above particular embodiment of the invention has been shown and described, it will be understood by those skilled in the art that various modifications, changes, and improvements may be made without departing from the spirit of the invention.

For example, in the previous embodiment, the front-side ring washer 28 is interposed between the snap ring 30 and the lever washer 27. However, the front-side ring washer 28 can be omitted so that the backward movement of the lever washer 27 is directly restricted by the snap ring 30.

On the contrary, it also is possible to further interpose at least one intermediate washer between the front-side ring washer 28 and the lever washer 27. In this case, the intermediate washer preferably has an outer diameter that is larger than the outer diameter of the ring washer 28 and smaller than the outer diameter of the lever washer 27, thereby making it more difficult for the ring washer 28 to drag the lever washer 27 to rotate therewith.

In the previous embodiment, the grease blocking member is provided in the form of the side wall 71*d* which is integrally formed with the lever ring 71.

However, the grease blocking member also can be provided in other possible ways. For example, the grease blocking member can be provided by joining a resin-made ring to the radially outer periphery of the axial end face of the lever ring 71 with an adhesive.

In the previous embodiment, the present invention is applied to the starter 1 where the pinion 6 is provided on the output shaft 5 and the shift lever 7 shifts the pinion 6 by shifting the output shaft 5. In other words, in the starter 1, the output shaft 5 serves as a pinion carrier to carry the pinion 6.

However, the present invention also can be applied to a starter where: a cylinder is provided on the output shaft 5 so as to be rotatable along with the output shaft 5 and axially movable with respect to the output shaft 5; the pinion 6 is provided on the cylinder; and the shift lever 7 shifts the pinion 6 by shifting the cylinder. In other words, in this starter, the cylinder serves as a pinion carrier to carry the pinion 6.

What is claimed is:

1. A starter for starting an engine, the starter comprising:

a motor;

a pinion;

a pinion carrier which carries the pinion and is driven by the motor to rotate together with the pinion;

a ring member provided on the pinion carrier, the ring member being rotatable relative to the pinion carrier and restricted in movement in an axial direction of the motor toward the pinion;

a shifting member having a ring portion arranged on the pinion carrier with the ring member interposed between the ring portion and the pinion in the axial direction, the ring portion having an axial end face that has a recess for receiving lubricant and is covered by the ring member, the shifting member being configured to shift, by pushing the ring member with the ring portion, the pinion in the axial direction, thereby bringing the pinion into mesh with a ring gear of an engine to start the engine;

a lubricant blocking member positioned radially outside the recess of the ring portion of the shifting member to block the lubricant which leaks out of the recess from being scattered radially outward due to rotation of the pinion carrier with the pinion the lubricant blocking member is defined by a side wall of the shifting member which protrudes from a radially outer periphery of the axial end face of the ring portion of the shifting member in the axial direction toward the pinion, and the side wall of the shifting member has a height in the axial direction which is greater than an axial thickness of the ring member.

2. The starter as set forth in claim 1, wherein the pinion carrier is a rotary shaft which is located outside of the motor and driven by the motor.

3. The starter as set forth in claim 1, wherein the side wall of the shifting member is formed so that when the starter is installed to the engine, the side wall occupies at least a vertically lower half of an outer circumference of the ring portion of the shifting member.

4. The starter as set forth in claim 1, wherein the shifting member further includes an arm portion that is pivotally held by a shifting-member holder of the starter, the ring portion includes a pair of connecting portions that are connected to the arm portion and opposite to each other in a radial direction of the ring portion, and both the connecting portions are offset from an axial center of the ring portion in the axial direction toward the pinion.

5. The starter as set forth in claim 4, wherein the side wall of the shifting member extends in a circumferential direction of the ring portion to connect together the connecting portions of the ring portion.

6. The starter as set forth in claim 1, further comprising a second ring member which is:

interposed on the pinion carrier between the pinion and the ring member, rotatable relative to the ring member, restricted in movement in the axial direction toward the pinion, and pushed by the ring portion of the shifting member via the ring member in the axial direction to bring the pinion into mesh with the ring gear of the engine.

7. The starter as set forth in claim 6, wherein the second ring member has a smaller outer diameter than the ring member.

8. The starter as set forth in claim 7, further comprising at least one intermediate ring member which is interposed on the pinion carrier between the ring member and the second ring member and rotatable relative to the pinion carrier.

9. The starter as set forth in claim 8, wherein the at least one intermediate ring member has an outer diameter that is smaller than the outer diameter of the ring member and larger than the outer diameter of the second ring member.

10. The starter as set forth in claim 1, wherein the shifting member is made of resin.

* * * * *